US005297367A

United States Patent [19]

Sainz

[11] Patent Number: 5,297,367

[45] Date of Patent: Mar. 29, 1994

[54] REMOVABLE STORM DRAINAGE CARTRIDGE

[76] Inventor: Jorge R. Sainz, 649 SW. 9th St., No. 103, Miami, Fla. 33130

[21] Appl. No.: 55,914

[22] Filed: Apr. 29, 1993

Related U.S. Application Data

[63] Continuation-in-part of Ser. No. 823,265, Jan. 17, 1992, abandoned.

[51] Int. Cl.[5] ..... E03F 5/16

[52] U.S. Cl. ..... 52/12; 52/20; 210/307; 137/247.33; 137/550

[58] Field of Search ..... 52/4, 12, 14–16, 52/19–21; 210/307, 310, 133, 490, 540, 52; 137/247.33, 550, 362

[56] References Cited

U.S. PATENT DOCUMENTS

| | | | |
|---|---|---|---|
| 143,774 | 10/1873 | Moore | 210/307 X |
| 781,014 | 1/1905 | O'Brien | 210/307 X |
| 790,254 | 5/1905 | Hannagan | 210/307 X |
| 814,481 | 3/1906 | Savard | 210/307 X |
| 1,703,769 | 2/1929 | Joachim | 210/307 |
| 1,982,348 | 11/1934 | Luff | 210/307 X |
| 4,045,346 | 8/1979 | Sworskey | 137/247.33 X |
| 4,238,333 | 12/1980 | Tidwell | 210/540 X |
| 4,707,269 | 11/1987 | Ohue et al. | 210/651 |
| 5,085,770 | 2/1992 | Eberhardt | 210/923 X |

FOREIGN PATENT DOCUMENTS

| | | | |
|---|---|---|---|
| 0273060 | 6/1927 | United Kingdom | 182/20 |

*Primary Examiner*—Carl D. Friedman
*Assistant Examiner*—Robert J. Canfield
*Attorney, Agent, or Firm*—Malin, Haley, DiMaggio & Crosby

[57] ABSTRACT

A removable storm drain cartridge to preserve the ground water quality to improve the environment for separating storm run-off water and removing oil and heavy debris from the storm run-off water, conveniently and inexpensively for use in a conventional storm drain, the cartridge including a heavy duty rectangular box container that is waterproof, an interior passage that is smaller in cross-sectional area that covers the top opening, forcing all storm water to flow through the interior passage first, the interior passage having a shortened length relative to the container length so that water flow will be out of the interior passage up the side walls of the exterior container out through openings in the top of the side walls. An oil trap is strategically located across the opening of the container to catch oil particles and remove them from the water flowing therethrough, while rocks, sand, and other debris will collect in the bottom of the container. The container can be periodically removed from the storm drain and emptied, preventing build-up of debris and oil within the storm drain.

1 Claim, 2 Drawing Sheets

REMOVABLE STORM DRAINAGE CARTRIDGE

This application is a continuation-in-part of Ser. No. 07/823,265 filed Jan. 17, 1992, now abandoned.

BACKGROUND OF THE INVENTION

1. Description of the Invention

This invention relates generally to a cartridge for insertion into a storm drain that receives run-off storm water and, in particular, to a removable storm drain cartridge that can separate the run-off water received into the storm drain from oil in the run-off water and heavy debris that is washed into the storm drain, such as stones and rocks and the like. The invention prevents storm drains from becoming periodically clogged along the entire pipeline or drain field, which requires replacement of the drain pipes or drain field.

2. Description of the Prior Art

Storm drains are known and are essentially deep holes in the ground which typically are encompassed in a concrete structure having feeder drain pipes that take run-off water away from the particular area and transfer it to other desired locations, often to a sea or ocean or other suitable run-off area. The storm drain system is completely different than the sewer lines and each storm drain is localized often and just has a drain field surrounding the large cement enclosure that is disposed below ground level for receiving run-off water.

Of particular concern these days is the fact that many chemicals, especially oil which floats on water and which may be on the streets and areas around the storm drain, can often be swept down into the storm drain when a rainstorm occurs, as part of the run-off water. The oil then will be continuously transferred into the particular surrounding area around the drain, which is undesirable. Also, the storm water will force, through the force of rushing water, stones, sand and rocks and the like to be received into the storm drain. These materials and other debris will then build up and recede into the drain pipes themselves, which can result ultimately in short periods of time that the drain pipes become clogged with debris. When this happens, it completely requires new drain field and, in effect, makes the storm drain inoperative. It would be extremely difficult for people to go down and try and clean out the drain pipes from the debris that is received into the storm grates. The top of the storm grates are wide enough so that sufficient run-off water can freely flow into the storm drain with no filtering effect. This permits large rocks, sand, and stones to be received into the drain, along with oil and other toxic liquids.

The present invention provides for a removable cartridge made of a strong durable material that can be inserted in existing storm drains because of its size and structural shape, that does not interfere with the flow of the storm drain waters, that acts as a collector for oil which is trapped as it flows into the cartridge and for solids such as rocks, sand, and other debris which collect due to their weight in the bottom of the cartridge, while still allowing the storm drain water to flow through the cartridge and continue into the storm drain and the drain pipes or drain field. Periodically, the size of the device allows it to be conveniently emptied so that the rocks and debris can be collected and removed without entering the storm drain pipes or drain field.

SUMMARY OF THE INVENTION

A storm drain cartridge that is insertable into an existing storm drain for the trapping of oil and the collection of solid debris that flows into a storm drain, while not inhibiting the flow of water into the storm drain. The storm drain cartridge is comprised of a rigid elongated container which can either be rectangular or circular in cross-section or any desired shape that includes a first internal passage and an outside substantial container, which cooperate together to divert the water which is received into the storm drain through the internal passage vertically and downwardly towards the solid bottom of the exterior container. The exterior container also includes side ports about its periphery near the top which, in conjunction with the internal passage, diverts the water as the cartridge itself is filled by the flow force out through the upper passages into the surrounding storm drain.

Rigidly fixed across the upper opening of the internal passage, which itself extends longitudinally through the exterior container to a point adjacent the bottom of the container, is a large oil trapping cloth and frame disposed across the upper opening of the internal chamber such that as water flows through the drain grate that protects the upper opening of the storm drain, any oil suspended in the storm water which flows through the absorbent cloth pad will be trapped in the pad while the water can flow continuously therethrough. Any stone or debris will pass by the pad and be transferred because of the flow force and gravity to the bottom of the exterior container.

Because of the weight of heavy debris such as stones and rocks, the stones and rocks will be trapped in the bottom of the container because the internal passage acts as a funnel for the incoming storm water at a location sufficiently above the bottom floor of the external container to force the storm water to make a 180° turn, forcing it upward along the inside wall of the exterior container through the upward ports on the outside of the container, thus leaving the heavy debris such as stones trapped in the bottom of the container.

The oil cloth absorbent pad may be mounted in a wire mesh housing which can be removed from the cartridge manually and replaced periodically once it has trapped a sufficient amount of oil to reach its absorbent maximum of oil.

The rigid external container and the internal passage forming the entire cartridge can be made of a durable material such as fiberglass or heavy duty plastic or any suitable material, including metal, that will provide sufficient support structure for the device to be operated.

The exterior container includes at least two connectors, one on each side, that allows the entire cartridge to be lifted out of the storm drain by hydraulic means such as may be on a tractor or the like. This will allow any collection of sand, stones and debris to be emptied periodically.

It is an object of this invention to provide an improved storm drain cartridge that can be formed as an original storm drain component or that can be retrofitted and inserted into existing storm drains.

It is another object of this invention to provide a removable and insertable storm drain cartridge into a storm drain that can be periodically cleaned that is to trap oil and solids received into the storm drain.

In accordance with these and other objects which will become apparent hereinafter, the instant invention will now be described with particular reference to the accompanying drawings.

PREFERRED EMBODIMENT OF THE INVENTION

Figure 1:
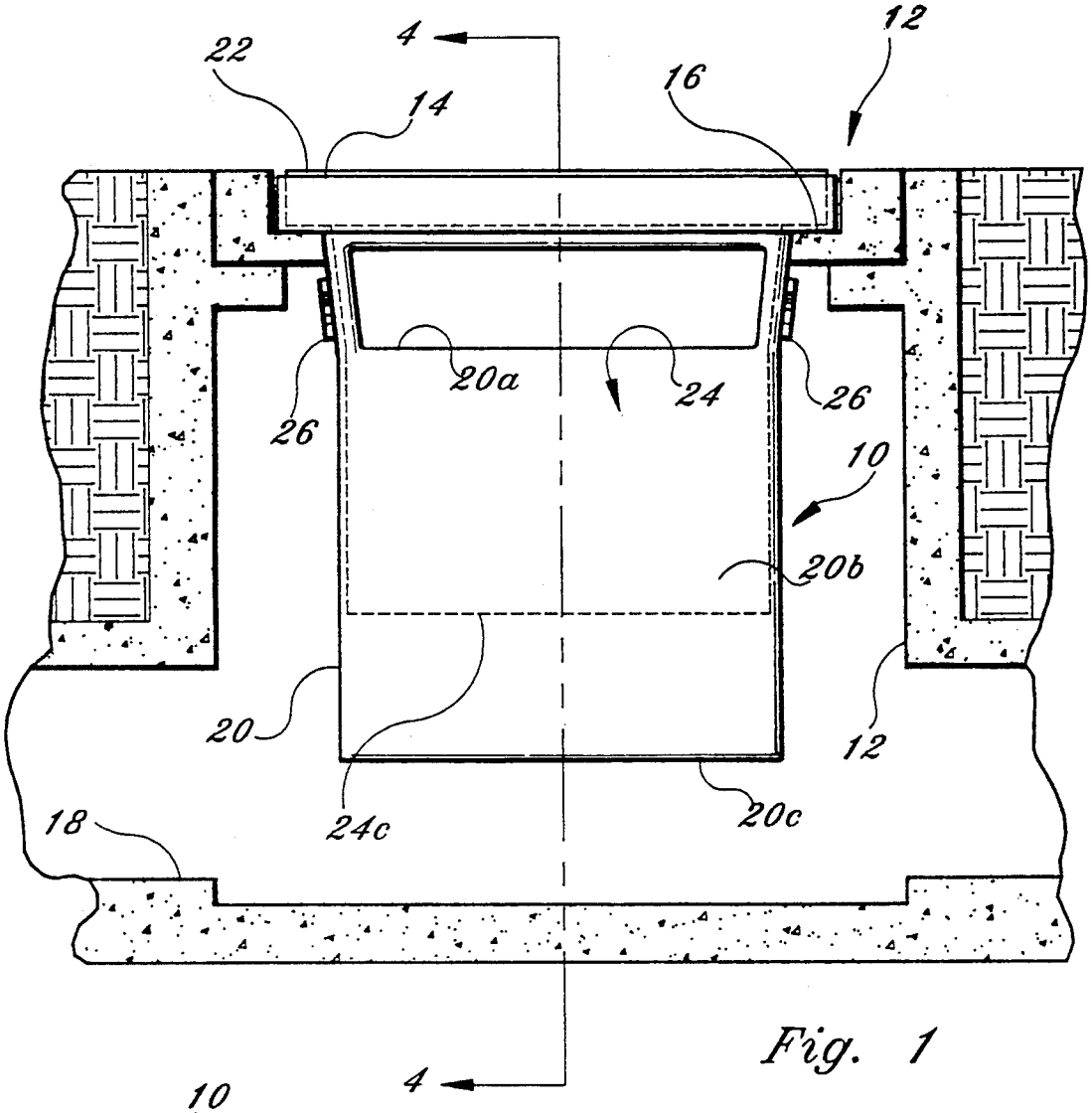
FIG. 1 shows a side elevational view in cross-section of the present invention mounted in a typical storm drain.

Referring now to FIG. 1, the present invention is shown generally at 10 mounted in a typical storm drain 12 having a drain cover or grate 14 which is made of a rigid heavy metal and has several openings, all of which are conventional and found over most storm drains. The storm drain has a support upper lip 16 that is used to support the upper grate 14 and also to support the present invention 10, which acts as a cartridge. Within the storm drain walls 12, which are typically made of cast iron or concrete and formed in the earth several feet deep to fill with water which ultimately is transferred out of a drain pipe 18, several of which are mounted around the base of the storm drain.

The storm drain 12, as shown, is conventional in construction and does not per se form part of the invention.

Figure 3:
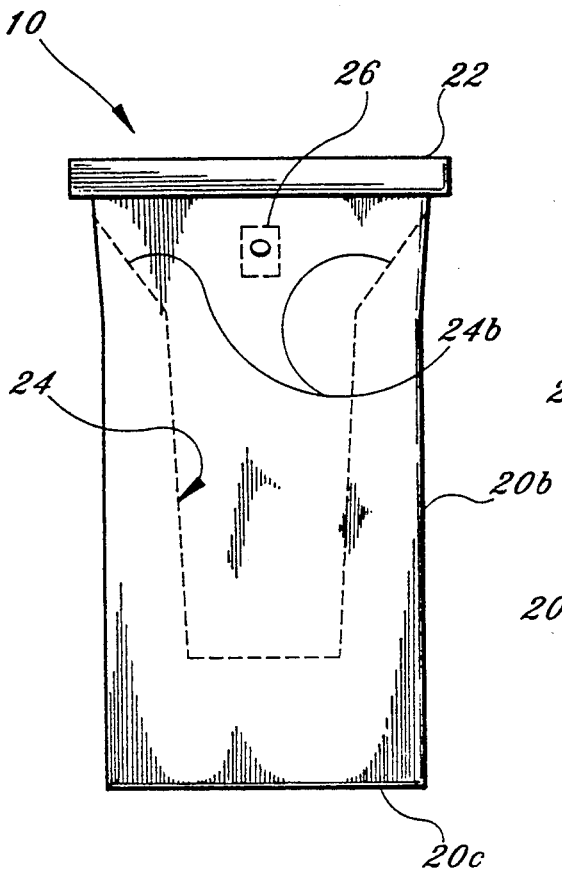
FIG. 3 shows a side elevational view of the present invention with the internal channel shown in phantom.
Figure 4:
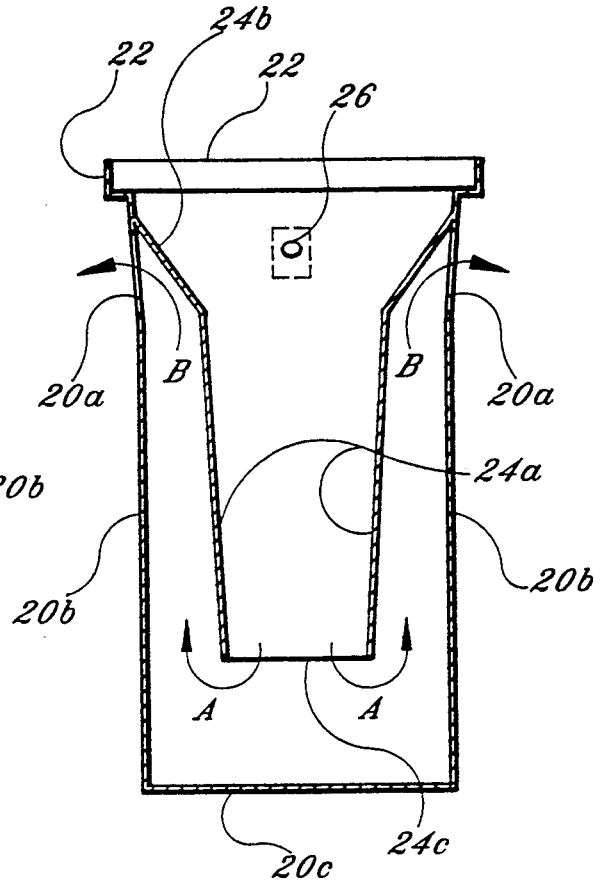
FIG. 4 shows the side elevational view of FIG. 3 in cross-section.
Figure 5:
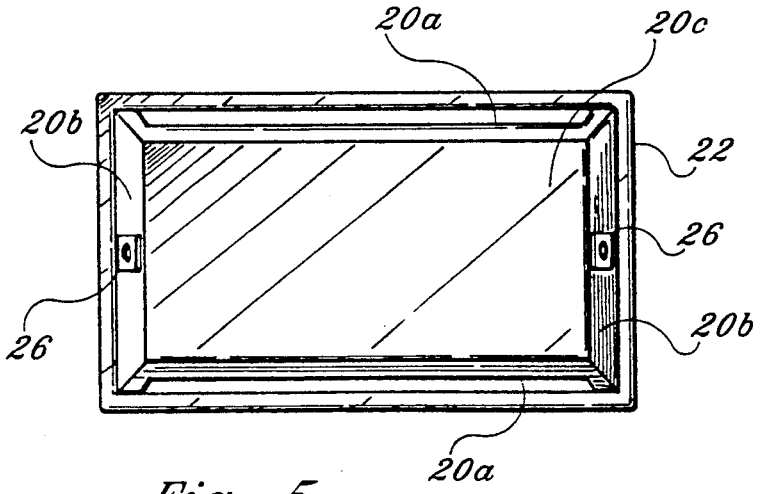
FIG. 5 shows a bottom plan view of the present invention.

The purpose of the invention, however, is to ensure that drain pipes 18 which exit out of storm drain 12 do not become clogged with sand, stones or rocks in accordance with the invention. When viewed in FIG. 1, the elongated side of the invention 10 is shown, while the views in FIGS. 3 and 4 are basically the narrow end elevation views. The invention 10 is comprised of a rigid fiberglass, shown as rectangular housing in this view, that includes an upper support lip 22 which is an integrally formed peripheral rim around the top of the invention and which can be sized to fit on the perimeter opening of the storm drain 16 and supported therefrom. The housing includes container 20 and also includes an elongated rectangular port **20*a* essentially traversing the side upper portion of the container 20 exterior wall 20*b* which allows water to flow out of the external container 20. The container has a rigid bottom 20*c* which is integrally formed with the sides 20*b* to form, in effect, a closed container except for the open top and the side ports 20*a* on each side. The rectangular side ports 20*a* which are formed in the rigid side walls 20*b* of the exterior container are the openings which permit storm water to flow therethrough into the storm drain 12** during a storm.

Figure 2:
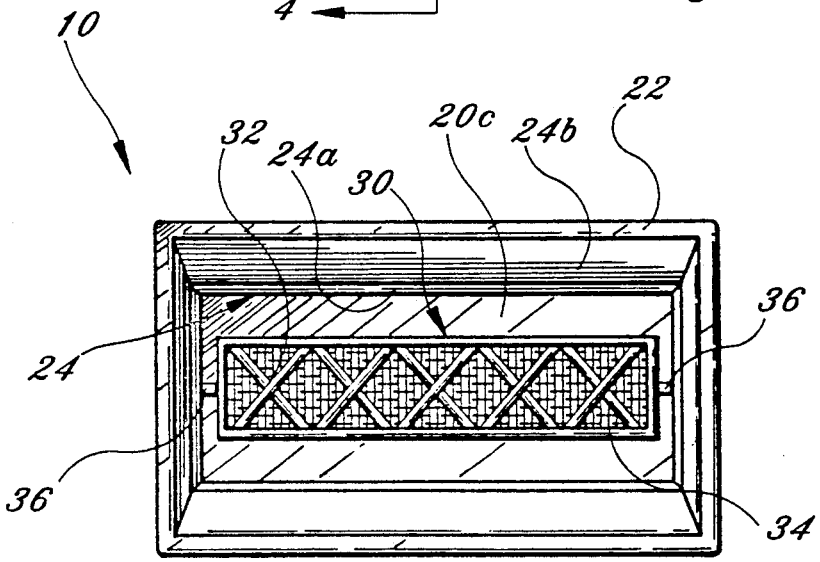
FIG. 2 shows a top plan view of the present invention outside of the storm drain.

Referring now to FIG. 2, the present invention is shown from a top view and only the internal channel 24 is visible, which includes upper tapered side walls **24*b* and the lower portion side walls 24*a*. The internal channel 24 is open at its bottom and the opening is approximately 6 to 12 inches above the bottom of the exterior container 20*c*. The upper rim 22 is integrally formed with the outer container 20 which is not visible because of the peripheral rim 22 and the displacement of the interior passage which is substantially rectangular that is uniformly and unitarily formed within the external container 20**.

FIG. 3 shows the invention 10 again with the internal passage 24 dotted showing its tapered upper walls **24*b*** which divert the water that comes into the cartridge downward through the internal passage.

Referring back to FIG. 2, an oil trap or filter 30 is shown that includes a metal or rigid frame 32 that can be a wire mesh that includes inside an oil absorbent cloth or pad 34 substantially the length across the opening which is pivotally mounted and removable by fasteners 36 so that water striking the pad will, if it contains oil, trap the oil in the pad and allow the water to fall freely to the bottom of the external container.

Again referring to FIG. 4, and especially the interior channel 24 shown with its tapered upper walls unitarily formed with lip 22 and as part of the overall device to allow water to flow and all incoming water coming into the storm drain will be received into the cartridge through the internal passage, which will strike the oil trap 30 (FIG. 2) and by gravity transfer to the bottom of the exterior container 20 which, as it fills, forces the water under dynamic situations out of the top ports **20*a*. The flow of the water is shown with arrows A out of the bottom of the internal passage 24 and forced up through the side walls and out the top 20*b***.

Referring back to FIG. 2, the oil trap 30 is shown smaller than the opening, but can be varied in size to trap all oil flowing through water coming down into the system. As shown, a wire mesh having wire or metal elements 32 can be criss-crossed on both sides and attached to a frame **32*a* that encompasses a special kind of material forming pad 34 such as POWERSORB oil sorbent rolls from 3M Company. These are manufactured from 100% polypropylene in order to absorb ten or more times its weight in oil. Each roll may be coated with an anti-static material in order to dissipate static charge buildup that is packed throughout the wire mesh from end to end and about the frame that specifically traps oil while letting water flow through. The particular wire mesh lattice work and spacing is not absolutely critical to the invention. The connectors 36 could be such to allow an axle to be placed into a side aperture in the inner channel wall for holding and receiving the filter, which can be removed by slightly deforming the wall by pushing to allow the shaft to be removed. Any other types of fasteners, including nuts and bolts and the like, can be used. The overall rectangular size of the frame and thickness can be such to adjust to cover the opening down through the interior passage 24**.

Looking at FIGS. 1 and 4, the invention is shown to operate as follows. A desired storm drain is selected to receive the cartridge in accordance with the present invention. When the cartridge is empty, it can be lowered manually or through the use of the connectors 26 mounted on each end of the cartridge near the top which have holes to receive hooks that can be fastened to any type of crane or lifting device for lowering the unit into the storm drain 12. The top grate 14 is placed over the storm drain in a conventional way, while the cartridge itself rests on the peripheral lip 22 on the storm drain mount 16. The height of the cartridge is sized so that it will leave sufficient space at the bottom of the storm drain for large amounts of water to flow into the storm drain system and out of the cartridge itself.

Once the cartridge is in place and the grate is in place, storm water will surge through the grate and down into the interior passage, with none of the water being allowed to flow around the cartridge. In other words, all storm drain water must flow through the cartridge. As it flows into the cartridge, the oil trap 30, as shown in FIG. 2, will thus catch oil and other similar type chemicals in the oil trap cloth 34, while letting the water flow therethrough. Heavy rocks and stones, since the oil trap 30 can pivot, will drop through the interior passage to the bottom of the cartridge and rest on the bottom wall 20*c* which is waterproof and will retain the rocks and stones and debris. The force of the water flowing in will force the water upward along the inside walls of outside container 20*b*, forcing it out as in arrow B through the top ports 20*a*, where the water will then be received without debris and oil into the storm drain.

The particular shape of the cartridge can be as desired; that is, it could be round, square or rectangular, depending on the particular storm drain configuration. The present invention is envisioned for use in existing storm drains of which there are hundreds of thousands throughout the United States. After a predetermined amount of time, depending on the amount of rain and other factors in a particular location or geographical area, the people maintaining the storm drains can periodically check the storm drain for debris and oil collection and, using the connectors 26 mounted as holes on the side of the exterior container 20, a pair of hooks can be placed in the holes with a rigid metal plate for strengthening the side walls mounted thereto, with the entire unit being hoisted out of the hole or storm drain, where it can be dumped into a truck that will cart the debris away. The cartridge is then returned back to the storm drain completely free of debris. The user or operator will also change the oil trap if necessary.

The use of the present invention and the significance of it cannot be underestimated in terms of the tremendous environmental value regarding the prevention of polluting ground water by oil and chemicals; and substantial savings to a municipality or other governmental agency that must maintain storm drains. It is not uncommon with conventional storm drains that they become clogged and unusable within a matter of a few years, which requires complete refurbishing, new drain fields, and a tremendous amount of cost and labor. The alternative is if a storm drain floods, flooding an entire neighborhood and homes can result, which is not a desirable alternative.

The significance of the present invention is that at very low cost, the removable cartridges can be inserted and collect debris and oil, thus preventing the drain fields and piping from becoming clogged and improving the quality of our ground water.

One of the important aspects of applicant's invention is that the cross-sectional areas representing flow are strategically determined so that the device permits a flow equal to those the storm drain intended design through the device so that storm flooding and the use of the storm drain will not be impeded through the use of the cartridge. For example, the cross-sectional area of the entire container or cartridge body, when considered from a top plan view, is determined in conjunction with the top plan cross-sectional area of the interior channel or passage or conduit so that the spacing and configuration between the inside side walls of the container and the outside and inside walls of the interior channel permit sufficient water flow in conjunction with the port or opening cross-sectional area of the side wall opening so that water flow is not impeded.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A removable storm drain cartridge for insertion into a conventional storm drain, said cartridge used for separating storm run-off liquid and debris, such as sand, stones and rocks to prevent collection of debris within the storm drain itself or the storm drain pipes, said storm drain cartridge comprising:

a sturdy longitudinally elongated water retaining container for receiving storm run-off liquid and collecting heavy debris, said container sized in length to penetrate longitudinally a significant portion of the storm drain to allow large flow through volume for mounting within a conventional storm drain, said elongated container including at least one continuous enclosing side wall and a bottom connected to said side wall and an open top;

means connected to the top of sad container to provide a support for said container within said storm drain;

internal conduit means having a first open end and a second open end, said first open end connected across the open top of said container covering the open top of said container, and said second conduit opening end mounted within said container a predetermined distance from said container bottom;

said continuous side wall including at least one opening in said container at a predetermined location near the top of said container relative to said internal conduit means second open end such that store liquid can flow into said container and into said internal conduit means first open end, flow through said internal conduit means and flow out of said internal conduit means in said container and flow out said opening in said continuous side wall, whereby debris that are heavy enough to not flow upwardly out of said opening in said container side wall will be collected within said container at the bottom and the water level remaining in said container is defined by the opening in said continuous side wall;

means for trapping oil connected across sad internal conduit means first open end for removing and trapping oil from said storm liquid entering said container;

wherein said oil trapping means includes a pad for trapping oil particles and a frame means for holding said pad in a predetermined position adjacent said opening, said oil trapping means being movable to allow debris and other objects to flow adjacent said oil trapping means, preventing environmental pollution.

* * * * *